US008360046B2

(12) United States Patent
Kim et al.

(10) Patent No.: US 8,360,046 B2
(45) Date of Patent: Jan. 29, 2013

(54) CUTTING TIP, METHOD FOR MAKING THE CUTTING TIP AND CUTTING TOOL

(75) Inventors: Tae-Woong Kim, Seoul (KR); Joong-Cheul Yun, Seoul (KR); Young-Choul Song, Kyungki-do (KR); Sang-Beom Kim, Seoul (KR); Jung-Nam Park, Kyungki-do (KR); Suk-Hyun Yoo, Kyungki-do (KR); Tae-Bong Kim, Kyungki-do (KR)

(73) Assignee: EWHA Diamond Industrial Co., Ltd., Kyungki-Do (KR)

( * ) Notice: Subject to any disclaimer, the term of this patent is extended or adjusted under 35 U.S.C. 154(b) by 1107 days.

(21) Appl. No.: 12/280,469

(22) PCT Filed: Feb. 23, 2007

(86) PCT No.: PCT/KR2007/000943

§ 371 (c)(1), (2), (4) Date: Nov. 18, 2008

(87) PCT Pub. No.: WO2007/097584

PCT Pub. Date: Aug. 30, 2007

(65) Prior Publication Data

US 2009/0139509 A1 Jun. 4, 2009

(30) Foreign Application Priority Data

Feb. 24, 2006 (KR) ..... 10-2006-0018064
Feb. 23, 2007 (KR) ..... 10-2007-0018210

(51) Int. Cl.
*B24D 1/04* (2006.01)

(52) U.S. Cl. ..... 125/15; 125/39; 125/13.01; 451/541; 451/542; 451/547

(58) Field of Classification Search ..... 125/15, 125/39, 13.01; 51/307, 309; 451/541, 542, 451/544, 547, 548
See application file for complete search history.

(56) References Cited

U.S. PATENT DOCUMENTS
(Continued)

FOREIGN PATENT DOCUMENTS

JP 60-099568 6/1985
JP 01-188275 7/1989

(Continued)

OTHER PUBLICATIONS

Japanese Patent Office, Office Action, Jun. 7, 2011.

(Continued)

*Primary Examiner* — George Nguyen
(74) *Attorney, Agent, or Firm* — Renner, Otto, Boisselle & Sklar, LLP

(57) ABSTRACT

The present invention relates to a cutting tip for a cutting tool, which is used in cutting or drilling a brittle workpiece such as stone, bricks, concrete, and asphalt and has an excellent cutting speed and a long lifetime, a method of manufacturing the cutting tip, and a cutting tool including the cutting tip. The cutting tip includes an abrasive material and a sintered bonding material, wherein the bonding material is formed of a metal matrix; the metal matrix includes a phase II and/or pore having a certain size at a certain volume fraction; and the phase II is one of a non-metallic inclusion and ceramic. According to an aspect of the present invention, there is provided a cutting tip having excellent cutting speed and a long lifetime at a much lower price.

15 Claims, 3 Drawing Sheets

U.S. PATENT DOCUMENTS

| | | | | | |
|---|---|---|---|---|---|
| 2,730,439 | A | * | 1/1956 | Houchins | 51/307 |
| 2,734,812 | A | * | 2/1956 | Robie | 51/298 |
| 3,850,590 | A | * | 11/1974 | Chalkley et al. | 51/298 |
| 4,505,251 | A | * | 3/1985 | Stoll | 125/15 |
| 4,636,253 | A | | 1/1987 | Nakai et al. | |
| 4,705,017 | A | * | 11/1987 | Lewis | 125/15 |
| 4,977,710 | A | * | 12/1990 | Une | 51/309 |
| 5,637,123 | A | | 6/1997 | Ishizaki et al. | |
| 5,791,330 | A | * | 8/1998 | Tselesin | 125/15 |
| 6,485,533 | B1 | * | 11/2002 | Ishizaki et al. | 51/307 |
| 6,679,758 | B2 | * | 1/2004 | Bright et al. | 451/28 |
| 6,769,975 | B2 | * | 8/2004 | Sagawa | 451/541 |
| 6,935,940 | B2 | * | 8/2005 | Skeem et al. | 451/547 |
| 2001/0000838 | A1 | * | 5/2001 | Nagata et al. | 51/298 |
| 2003/0041525 | A1 | * | 3/2003 | Sherwood, Jr. | 51/307 |

FOREIGN PATENT DOCUMENTS

| | | |
|---|---|---|
| JP | 3101145 | 4/1991 |
| JP | 03-245974 | 11/1991 |
| JP | 05-043463 | 2/1993 |
| JP | 10-296636 | 11/1998 |
| JP | 11-116227 | 4/1999 |
| JP | 2002-273882 | 9/2002 |
| JP | 2003-181765 | 7/2003 |
| JP | 3456979 | 10/2003 |
| KR | 2001/0032738 | 4/2001 |
| KR | 2004/0075220 | 8/2004 |

OTHER PUBLICATIONS

Japanese Office Action for corresponding Japanese patent application No. 2008-556249 issued on Nov. 22, 2011.

Search Report for corresponding application No. PCT/KR07/00943 dated Jun. 1, 1999.

* cited by examiner

CUTTING TIP, METHOD FOR MAKING THE CUTTING TIP AND CUTTING TOOL

This application is a national phase of International Application No. PCT/KR2007/000943 filed Feb. 23, 2007 and published in the English language.

TECHNICAL FIELD

The present invention relates to a cutting tip for a cutting tool, used in cutting or drilling a brittle workpiece such as stone, bricks, concrete, and asphalt, a method of manufacturing the cutting tip, and a cutting tool including the cutting tip, and more particularly, to a cutting tip for a cutting tool, having an excellent cutting speed and a long lifetime all together by improving microstructure of a bonding material of the cutting tip, a method of manufacturing the cutting tip, and a cutting tool including the cutting tip.

BACKGROUND ART

To cut or drill a brittle workpiece such as stone, bricks, concrete, and asphalt, an abrasive material having a higher hardness than the workpiece is required.

As the abrasive material, there are synthetic diamond particles, natural diamond particles, boron nitride particles, and cemented tungsten carbide particles. The synthetic diamond particles are most generally used.

The synthetic diamond (hereinafter, referred to as a "diamond" is invented in 1950s, known as a material whose hardness is highest from materials existing on the earth, and used for cutting or grinding tools due to the characteristics.

Particularly, the diamond is generally used in a stone processing field of cutting or grinding granite and marble and a construction field of cutting or grinding concrete structures.

The cutting or grinding tools include a cutting tip including diamond particles for cutting a workpiece and a bonding material for maintaining the diamond particles.

Most of cutting tools have been formed by a powder metallurgy method of mixing, compacting, and sintering diamond particles with metal powder as a bonding material.

A cobalt powder has been most generally used as a bonding material for diamond cutting tools for a long time.

The cobalt bonding material is called as "an all-around bonding material" in the field of diamond tools because a cutting tip formed using a cobalt bonding material has an excellent cutting speed regardless of a workpiece such as granite, concrete, asphalt, and marble or whether horsepower (HP) of a cutting machine is high or low.

Since cobalt bonding materials are well abraded, diamond particles are well projected, thereby making cobalt bonding materials in the limelight as all-around bonding materials.

Since abrasion of a bonding material well occurs in small low power cutting machine of 2 to 3 HP, bad cutting does not occur.

However, since cobalt bonding materials are so quickly abraded in cutting machine of high HP, cutting speed is high but diamond particles are too early departed, thereby shortening a lifetime.

Recently, high HP machine is introduced and used for improving productivity of cutting granite, concrete, or asphalt.

In granite cutting factories, though large-sized multi-blade machine of 100 HP has been used during past 10 years, machine of 150 HP is generally used and machine of 200 HP is introduced now.

On the other hand, to improve cutting productivity, machine of 20 HP has been replaced with machine of 40 or 65 HP for cutting concrete or asphalt pavements. Even machine of 100 HP is used.

As described above, as a HP of cutting machine increases, a lifetime of cutting tool cannot be guaranteed by using a bonding material of pure cobalt.

A method of adding tungsten (W) and tungsten carbide (WC) is generally employed for slowing down abrasion of the cobalt bonding material.

Recently, to extend a lifetime of the bonding material, an amount of adding tungsten carbide has to be increased to 50 to 60%.

However, as the amount of adding tungsten carbide increases, problems as follows occur.

When cobalt (Co) and tungsten carbide (WC) form a bonding material, a sintering temperature has to be raised over 1000° C. to sinter the bonding material when an amount of tungsten is more than 50%.

As the sintering temperature is raised, thermal deterioration of diamond particles mixed with the bonding material cannot be avoided.

As the sintering temperature is raised, diamond particles are transformed to graphite and hardness of the diamond particles is rapidly decreased.

Therefore, in a diamond tool industry, it is tried to lower the sintering temperature to be less than 900° C. and a sintering temperature more than 1000° C. is avoided as far as possible.

This is because excellent cutting speed and a long lifetime cannot be acquired when the thermal deterioration of diamond particles gets worse.

Accordingly, the amount of tungsten carbide is reduced not to raise the sintering temperature. However, when the amount of tungsten carbide is reduced, the abrasion of cobalt cannot be slowed down.

Also, a cobalt bonding material is expensive, variation of the price of the cobalt bonding material is great, and there exists an environmental problem.

Accordingly, a lot of efforts for replacing the cobalt bonding material with another have been done. On the other hand, since iron is cheap and there are relatively few environmental problems, iron draws attentions to substitute for cobalt.

However, in the case of iron on the market, though carbonyl iron powder having a micro particle size is used, it is hard to get densified microstructure after sintering. Therefore, a high temperature of 1000° C. is required to raise a sintering density.

However, when a sintering temperature is raised, diamond particles mixed with a bonding material are transformed into graphite, thermal deterioration of diamond, in which strength of the diamond is rapidly dropped, is accelerated. When thermal deterioration of diamond particles gets worse, it is hard to get excellent cutting speed and a long lifetime.

Therefore, in a diamond tool industry, it is tried to lower the sintering temperature to be less than 900° C.

Also, due to physical properties such as hardness and a transverse rupture strength lower than the cobalt, a bonding material formed by sintering, iron powder is inferior in mechanical retention force for diamond and abrasion is not smooth to lower cutting, speed, thereby restricting application to diamond tools.

DISCLOSURE OF INVENTION

Technical Problem

To solve the problems of the conventional art, the present inventors provide the present invention based on the result of researches and experiments.

An aspect of the present invention provides a cutting tip for a cutting tool, having excellent cutting speed and a long lifetime in not only low HP dry cutting operations but also high BP wet cutting operations.

An aspect of the present invention also provides a method of more economically manufacturing a cutting tip for a cutting tool, having excellent cutting speed and a long lifetime in not only low HP dry cutting operations but also high HP wet cutting operations.

An aspect of the present invention also provides a cutting tool including a cutting tip having excellent cutting speed and a long lifetime.

Technical Solution

Awarding to an aspect of the present invention, there is provided a cutting tip for a cutting tool, the cutting tip including an abrasive material for cutting a workpiece and a sintered bonding material maintaining the abrasive material, wherein the bonding material is formed of a metal matrix formed of one of a metal and a metal alloy; a phase II and/or pore is included in the metal matrix at a volume fraction of 0.5 to 30%; the phase II is at least one of a non-metallic inclusion, ceramic, and cement; the phase II and the pore have a size less than 3 μm; and a distance between the phase II and the pores is less than 40 μm.

According to another aspect of the present invention, there is provided a cutting tip for a cutting tool, the cutting tip including an abrasive material for cutting a workpiece and a sintered bonding material maintaining the abrasive material, wherein the bonding material is formed of a metal matrix formed of one of a metal and a metal alloy; a phase II and/or pore is included in the metal matrix at a volume fraction of 0.5 to 30%; a phase III is included in the metal matrix at a volume fraction of 0.1 to 10%; the phase II is at least one of a non-metallic inclusion, ceramic, and cement and the phase III is a low melting point metal; the phase II and the pore have a size less than 3 μm; and the phase III has a size less than 5 μm.

According to still another aspect of the present invention, there is provided a cutting tip for a cutting tool, the cutting tip including a plurality of abrasive particles and a powder-sintered bonding material, wherein the powder-sintered bonding material is formed of a iron matrix; phase II is included at a volume fraction of 0.5 to 15% in the iron matrix or phase II is included at a volume fraction of 0.5 to 15% and a pore is included at a volume fraction less than 5% in the iron matrix; the phase II is at least one of a non-metallic inclusion and ceramic; a size of each of the phase II and the pore is less than 3 μm; a distance between the phase II and the pores is less than 40 μm; a hardness of the iron bonding material is more than 70 HRB; and a transverse rupture strength of the iron bonding material that does not include an abrasive material is more than 80 kgf/mm$^2$.

According to yet another aspect of the present invention there is provided a method of manufacturing a cutting tip for a cutting tool by mixing and hot-press sintering abrasive particles and a bonding material at a high temperature, the method including preparing one of a bonding material including a phase II component of 0.5 to 25 wt % and a matrix component formed of one of a metal and a metal alloy powder and a bonding material including a phase I component of 0.5 to 25 wt %, 0.1 to 10 wt % of phase III component formed of low melting point metal powder, and a matrix component formed of one of a metal and a metal alloy powder and mixing the bonding material by mechanical alloying; mixing the mixture with abrasive particles and a binder; granulating the mixed powder by using a high viscous volatile liquid whose viscosity is more than 3.0 cP; and hot-press sintering the granulated mixed powder after cold-compaction in a shape of a cutting tip.

According to a further aspect of the present invention, there is provided a cutting tool including the cutting tip.

Advantageous Effects

As described above, according to an aspect of the present invention, there are provided a cutting tip having excellent cutting speed and a long lifetime and a cutting tool at a low price.

BEST MODE FOR CARRYING OUT THE INVENTION

Figure 1:
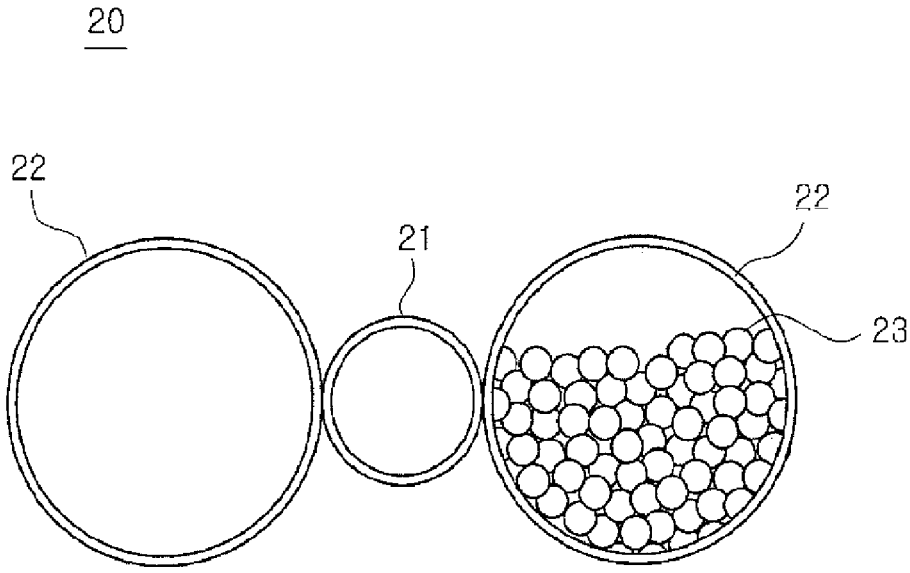
FIG. 1 is a schematic diagram illustrating an example of a vibration ill applied to mechanical alloying according to an exemplary embodiment of the present invention.

Exemplary embodiments of the present invention will now be described in detail.

The present invention will be applied to a cutting tip for a cutting tool, which includes an abrasive material cutting a workpiece and a sintered bonding material maintaining the abrasive material. Particularly, properties of the bonding material, such as a microstructure of the bonding material and mechanical characteristics, are improved.

The abrasive material may be anyone that generally used, such as synthetic diamond particles, natural diamond particles, boron nitride particles, and cemented tungsten carbide particles. Hereinafter, the abrasive material is simply referred to as "diamond".

The present inventor has performed researches and experiments with respect to properties of a bonding material, which has an effect on cutting speed and a lifetime of a cutting tip for a cutting tool, and more particularly, abrasion property, for a long time and has completed the present invention based on the result of the researches and experiments.

With respect to the cutting tip, the function of a bonding material will be described as follows.

First, the bonding material holds diamond particles to cut a workpiece during a cutting operation.

When the bonding material cannot hold the diamond particles enough, the diamond particles may be easily popped-out from the bonding material.

Since an operation of cutting a workpiece is performed by the diamond particles, when the diamond particles are easily popped-out, cutting speed is deteriorated and a lifetime of the cutting tip is rapidly decreased due to abrasion caused by a direct contact between the workpiece and the bonding material.

On the other hand, when the bonding material holds the diamond particles enough, a front end of a diamond particle becomes a sharp edge to cut the workpiece during the cutting operation.

During the cutting operation, a process in which the front end of the diamond particle is broken into a micro size and departed and a new edge is generated is repeated and the workpiece is cat. The cutting operation is continued until one diamond particle has been spent.

After the diamond particle is spent, a new diamond particle below is protruded again and the process is repeated to perform the cutting operation.

Namely, cutting speed and a lifetime of the cutting tip are improved at the same time when a diamond retention force of the bonding material is high but deteriorated at the same time when the bonding material cannot hold the diamond particle enough to be early departed.

Second, the bonding material suitably exposes the diamond particles to cat the workpiece during the cutting operation.

When the cutting tip is contacted with the workpiece and the cutting operation is performed, the diamond particles cut the workpiece.

In this case, the diamond particles have to be enough protruded from a surface of the bonding material on a front of the cutting tip.

When the bonding material is not abraded, the diamond particles are not enough protruded from the surface of the bonding material and an edge of the diamond particle is covered with the bonding material.

In this case, the edge of the diamond particle cannot cut the workpiece and the cutting speed is deteriorated. In the end, the cutting operation cannot be performed.

A phenomenon as described above is called as a glazing phenomenon.

In order to avoid the glazing phenomenon, the bonding material is suitably abraded and the diamond particle has to be protruded than the surface of the bonding material.

On the other hand, when a speed of the abrasion of the bonding material is too high, the lifetime of the cutting tip is decreased due to an early pop-out of the diamond particle as the case in which the bonding material cannot hold the diamond particle enough.

As described above, the abrasion of the bonding material may be an important metallurgical property on which the cutting speed and the lifetime of the cutting tip depend.

There are HP of a cutting machine, a bonding strength of the bonding material, and a composition of the workpiece as factors having an effect on the abrasion of the bonding material.

Since a cutting tool such as a saw blade is rotated when the workpiece is contacted with the cutting tip in the cutting operation, the HP of the cutting machine, for rotating the saw blade, has a direct effect on the abrasion of the bonding material of the cutting tip.

Namely, the abrasion speed of the bonding material is fast when the HP of the cutting machine is large, and the abrasion speed of the bonding material is slow when the HP is small.

Also, a bonding strength between powders in the bonding material has a great effect on the abrasion of the bonding material.

A bonding material of a cutting tip, formed by sintering, has a strong bonding strength when a contact area between the powders is large or a bonding strength between the powders.

An abrasion is not well performed when the bonding strength of the bonding material is strong, and the abrasion is well performed when the bonding strength is weak.

A component of the composition of the workpiece, whose hardness is highest, has a great effect on the abrasion of the bonding material.

For example, in the case of granite, since a quartz $SiO_2$ component has highest hardness, the abrasion of the bonding material becomes higher as an amount of the quartz component increases.

Namely, it is required that the abrasion of the bonding material is slowly performed in an aspect of fixing the diamond particle but it is required that the abrasion of the bonding material is quickly performed in an aspect of exposing the diamond particle.

An aspect of the present invention provides an improved bonding material satisfying requirements with respect to an abrasion property of a bonding material.

The present inventor performs deeper researches and experiments with respect to the abrasion property of the bonding material based on the functions of the bonding material.

The abrasion of the bonding material is well performed during the cutting operation to well protrude the diamond particle from the surface of the cutting tip.

However, in order to avoid an early pop-out of the diamond particle during the cutting operation, the bonding material holds the diamond particle for a long time and the abrasion of the bonding material is slowly performed.

As a result of the reaches and experiments, the present inventor may know that a bonding material has to be well broken away by a small force and a breakaway amount per hour has to be small to satisfy the required abrasion property.

The abrasion of the bonding material indicates that the bonding material is broken away into a particle and departed.

Accordingly, when the bonding material is broken away to particles by a small force, the abrasion is well performed.

When the bonding material is broken away by a small force into a small particle to the utmost, the abrasion may be well performed in a micro view and the abrasion is not performed because an amount of the abrasion is small in a macro view.

As a result, an aspect of the present invention provides a design of a microstructure of a bonding material in order to break away the bonding material into a small particle to the utmost by a small force.

The microstructure of the bonding material of a cutting tip according to an exemplary embodiment of the present invention is a metal matrix in which micro phase II and/or pore is uniformly distributed in the metal matrix.

The metal matrix is formed of one of a metal and a metal alloy.

The metal matrix may be one selected from a group consisting of one of Fe, Cu, Ni, Co, Cr, Mn, and W and one of an alloy of Fe, Cu, Ni, Co, Cr, Mn, and W and stainless steel.

The phase II may be at least one selected from a group of a non-metallic inclusion, ceramic, and cement.

The non-metallic inclusion may be one of a metal oxide, a metal nitride, a metal carbide, a metal carbonitride, and a metal sulfide.

A size of phase II and/or pore is less than 3 μm, and one of an individual amount or a total amount is of the phase II and/or pore a volume fraction of 0.5 to 30%.

The phase II and/or pore has no bonding strength with the matrix metal or has a weak bonding strength. Since the phase II and/or pore becomes an origination of a crack and is connected to the crack to be easily broken away into a particle, the phase II and/or pore is distributed in the metal matrix.

The size of the phase II and pore is limited to 3 μm, because a size of the particle broken away is too large when the size of the phase II and/or pore is more than 3 μm. Therefore, the phase II and pore cannot be connected to the crack, and even, an abrasion amount per hour increases to be departed from a basic principal.

Also, since an impact strength of the sintered bonding material is low when the size of the phase II and pore is large, the cutting tip is easily broken by a small impact and cannot be used for a cutting tool.

As described above, when the total amount of the phase II and pore is more than a volume fraction of 30%, the cutting tip is easily broken by the small impact. When the volume fraction is less than 0.5%, the matrix of the bonding material cannot be broken away into a particle and is deformed by slip and abraded into a lump.

A distance between the phase II and pores may be less than 40 μm.

In this case, the distance between the phase II and pores indicates a distance between the phase II and phase II, a distance between the phase II and the pore, and a distance between the pore and pore.

In a condition of the volume faction and size of the phase II and the pore, the distance between the phase II and pores may be less than 40 μm. When the distance is more than 40 μm, an effect of adding the phase II and existence of the pore is not great and the bonding material may be deformed by slip and abraded into a lump.

Also, a microstructure of a bonding material of a cutting tip according to another embodiment of the present invention is a metal matrix in which a phase III of a low melting point metal is uniformly distributed together with the micro phase II and/or pore.

The phase III is a low melting point metal and is wetted with the metal matrix together with the micro phase II and pore.

The phase III may be at least one of tin (Sn) and a bronze alloy (Cu—Sn). A size of the phase III may be less than 5 μm. An amount of the phase II may be a volume fraction 0.1 to 10%. More preferably, the amount of the phase III may be 0.1 to 5%.

A melting point of the tin (Sn) is 233° C., and the bronze alloy has a melting point between 232 to 1083° C. according to a fraction of copper (Cu).

Since a sintering temperature of the cutting tip is high, the low melting point metal in the bonding material is melted into a liquid phase and penetrates a grain boundary of a matrix metal during an operation of sintering the cutting tip.

Namely, liquid phase sintering is performed.

The low melting point metal of a film type, penetrating the grain boundary of the matrix metal, enables the bonding material to be easily broken away into a micro particle.

The low melting point metal has a feature of being wetted with the matrix metal such that the low melting point metal may penetrate the grain boundary of the matrix metal, in the film type.

When there is no the feature of being wetted, the low melting point metal cannot penetrate the grain boundary in the liquid phase sintering.

This is, the bonding material including the phase III penetrating the grain boundary of the matrix metal is broken away by a smaller force than the bonding material including the phase III that does not penetrate the grain boundary of the matrix metal.

Namely, since the bonding, material is well abraded to a small particle by the small force, the bonding material will be well applied to low HP cutting such as dry cutting.

On the other hand, the phase III distributed in the form of a grain in the mix crostructure of the bonding material is superfluous phase II left behind after penetrating the grain boundary in the film type and is unnecessary in theory.

However, through a lot of experiment processes, it has been known that it is difficult to determine whether the low melting point metal penetrate large enough the grain boundary of the matrix metal.

Accordingly, whether the grain boundary is penetrated large enough in the film type is determined by considering a superfluous amount of the phase III distributed in the form of a grain in the microstructure of the bonding material.

Since strength of the cutting tip is deteriorated due to a too large amount of the superfluous phase III when the volume fraction of the amount of the phase III distributed in the form of a grain is more than 10%, the volume fraction of the amount of the phase III is limited to 0.1 to 10%.

Also, when the amount is less than 0.1%, the phase III penetrates large enough the grain boundary of the matrix metal.

When a size of the phase III existing in the matrix metal is more than 5 μm, since the phase III is not uniformly distributed in the metal matrix and is segregated, the impart strength of the cutting tip is deteriorated.

The matrix metal of the bonding material may be iron (Fe).

When the iron is used for the matrix metal, only the phase II or both of the phase II and the pore may be included in an iron matrix.

A volume fraction of the phase II may be 0.5 to 15%, and a size of the phase II may be less than 3 μm.

Also, a volume fraction of the pore may be less than 5%, and a size of the pore may be less than 3 μm.

A distance between the phase II and the pores may be less than 40 μm.

The phase II and the pore have no bonding strength or have a weak bonding strength with the iron matrix. Since the phase II and the pore become an origination of a crack and are connected to the crack to easily break away the bonding material into a particle, the phase II and the pore are distributed in the iron matrix.

When an amount of the phase II is more than 15%, the cutting tip is easily broken by an external impact due to insufficient densification.

On the other hand, when an amount of the phase II is less than 0.5%, an effect of adding the phase II is not great and the iron bonding material may be deformed by slip and abraded into a lump.

Since the cutting tip is easily broken by an external impact when an amount of the pore is more than 5%, the amount of the pore may be limited to be less than 5%.

Since a rupture strength deviation of an iron bonding material increases due to lack of uniformity of size and distribution of the crack when a size of each of the phase II and the pore is more than 3 μm, the size of the phase II and the pore may be limited to be less than 3 μm.

In a condition of the volume faction and size of the phase II and the pore described above, the distance between the phase II and pores may be less than 40 μm. When the distance is more than 40 μm, an effect of adding the phase III and existence of the pore is not great and the iron bonding material may be deformed by slip and abraded into a lump.

Hereinafter, it will be described that mechanical characteristics of the iron bonding material is improved to satisfy the requirements with respect to a diamond retention force of the bonding material.

As the mechanical characteristics of the iron bonding material according to an exemplary embodiment of the present invention, a hardness of the iron bonding material may be more than HRB 70.

When the hardness of the bonding material is less than 70 HRB, the bonding maternal is easily plastic-deformed to generate a gab between the bonding material and the diamond particle, thereby, early popping-out the diamond particle. The hardness of the bonding material may be more than HRB 70.

Though a general iron bonding material has a hardness less than HRB 60, the iron bonding material according to an exemplary embodiment of the present invention has a high hardness due to dispersion hardening by uniformly distributing a micro phase II particle and a grain size refinement by recrystallization by annealing a mechanically alloyed powder in an sintering operation.

Generally, a hardness of a metal increases in inversely proportion to a size of a grain of the metal.

Also, traverse rupture strength of the iron bonding material may be more than 80 kgf/mm$^2$.

When the traverse rupture strength of a bonding material is less than 80 kgf/mm$^2$, the cutting tip may be easily broken.

The traverse rupture strength indicates a value when the iron bonding material does not include the diamond particles.

The value of the traverse rupture strength is generally reduced by 10 to 30 kgf/mm$^2$ when the iron bonding material includes the diamond particles.

Though a general iron bonding material shows traverse rupture strength less than 70 kgf/mm$^2$, the iron bonding material according to an exemplary embodiment of the present invention shows the traverse rupture strength more than 80 kgf/mm$^2$. Since a driving force of sintering largely increases due to micro cracks in a powder mechanically alloyed, almost full densification is performed during the sintering.

On the other hand, the cutting tip manufactured by the iron bonding material according to an exemplary embodiment of the present invention includes a smaller amount of diamond particles than a general cutting tip.

This is, since the diamond retention force of the iron bonding material is excellent, the diamond particles are not be easily popped-out.

Since the bonding material fixes the diamond particles till the end, a lifetime of all the diamond particles is lengthened. Accordingly, tough the amount of the diamond particles is smaller than a general amount of diamond particles, lifetime performance is similar to the general.

Though a cutting tip for a dry cutting tool includes diamond particles of a volume fraction of 3.5 to 5%, the cutting tip manufactured by using the iron bonding material according to an exemplary embodiment of the present invention may include diamond particles of a volume fraction of 2 to 4% and may have a lifetime similar to a general cutting tip.

As described above, since the amount of the used diamond particles is small, a cutting tip having similar performance may be manufactured at a low price.

On the other hand, the cutting tip manufactured by the iron bonding material may fully use a high-grade diamond whose grain size is large and toughness index (TI) is high.

The TI is an indication of an ability of a diamond particle enduring repeated impacts. When TI is high, a diamond particle can endure a hard operation condition for a long time without destruction.

Accordingly, when using the diamond particle whose grain size and TI is high, since it requires a long time to consume respective diamond particles, a lifetime of a cutting tool is largely improved.

Also, since a protrusion height of the diamond particle from a surface of the bonding material is high, cutting speed of the cutting tool is also largely improved.

Accordingly, application of the diamond particle whose grain size is large and TI is high is an effective method for increasing simultaneously the cutting speed and the lifetime of the cutting tool.

However, when the diamond retention force of the bonding material is not large, the diamond particle is easily, early popped-out. In this case, though the diamond particle whose grain size is large and TI is high is applied, the cutting speed and the lifetime of the cutting tool are not improved.

Accordingly, the iron bonding material may fully use a high-grade diamond whose grain size is more than 350 μm and TI is more than 85, thereby manufacturing a cutting tip having excellent cutting speed and lifetime.

Figure 5:
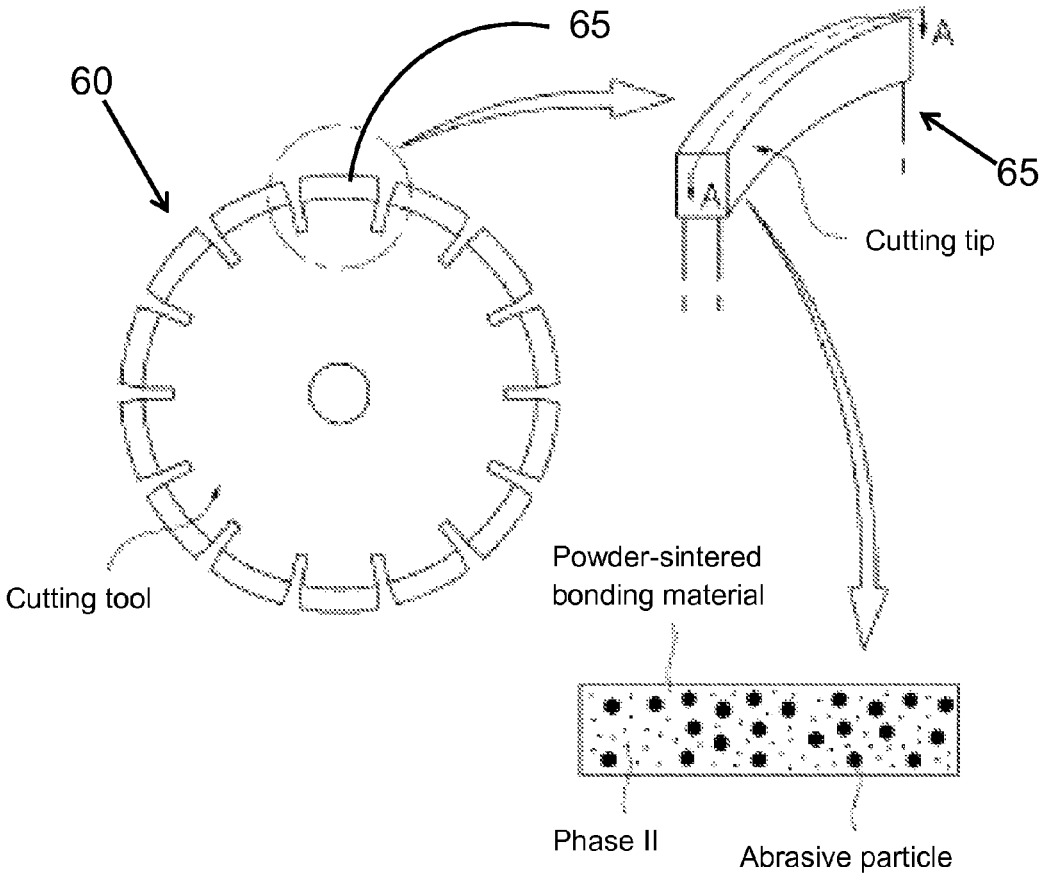
FIG. 5 is a schematic diagram illustrating an example of a generic cutting tool having a cutting tip including a plurality of abrasive particles and a powder-sintered bonding material according to an exemplary embodiment of the present invention.

Turning to FIG. 5, an aspect of the present invention also provides a cutting tool 60 including the cutting tip 65.

As representative cutting tools, there are a segment type cutting tool, a rim type cutting tool, a cup type cutting tool, a wire saw, and a core drill.

Hereinafter, a method of manufacturing a cutting tip for a cutting tool will be described in detail.

To manufacture the cutting tip according to an exemplary embodiment of the present invention, one of a bonding material including a matrix component formed of 0.5 to 25 wt % of a phase II component and one of a metal and a metal alloy powder and a bonding material including a matrix component formed of 0.5 to 25 wt % of phase II component, 01 to 10 wt % of phase II component, and one of a metal and a metal alloy powder is prepared and the bonding material is mixed by mechanical alloying.

The matrix component may be one of one selected from a group consisting of Fe, Cu, Ni, Co, Mn, and W and one selected from a group consisting of an alloy of Fe, Cu, Ni, Co, Mn, and W and stainless steel.

The phase II component is added to improve an abrasion property and may be at least one selected from a non-metal group consisting of a ceramic powder, a metal oxide, cement, and glass powder.

An amount of the added phase II component may be limited to 0.5 to 25 wt %.

When a volume fraction of the phase II component is more than 25%, sinterability of the bonding material is deteriorated and the cutting tip is easily broken by an external impact.

On the other hand, when the volume fraction of the phase II component is less than 0.5%, an effect of adding the phase II component is not enough. Therefore, the bonding material cannot be broken away into a small particle and is deformed by slip and abraded to a lump.

The phase III component is also added to improve the abrasion property and may be at least one of a tin (Sn) and a bronze alloy (Cu—Sn).

An amount of the added phase II component may be limited to 0.1 to 10 wt %.

When the amount of the added phase III component is less than 0.1 wt %, an effect of improving the abrasion property by adding the phase III component cannot be acquired enough. When the amount is more than 10 wt %, the phase II may act as a weak point and destruction of the sintered bonding material may be easily caused.

The present invention relates to a method of manufacturing a cutting tip for a cutting tool, including diamond particles and a sintered bonding material fixing the diamond particles. In the present invention, a mechanical alloying is applied to uniformly distribute a phase II component and a phase III component in a matrix and a high viscous volatile liquid is applied to granulate a powder of a large particle size.

In the method of manufacturing the cutting tip, the phase II component and the phase III component powder are uniformly mixed with the matrix component powder by the mechanical alloying and the mixed powder of the phase II component, the phase III component, and the matrix component is mixed with a binder and diamond particles.

Since there is a great difference of specific gravity and a grain size between the powder of the phase II component and the phase III component and the matrix component power, it is difficult to mix the matrix component powder with the phase II component and the phase III component powder by using a simple mixing method. Accordingly, there occurs segregation of the phase II particles and the phase III particles in the matrix of the bonding material after sintering.

Since the phase II and the phase III in the matrix of the bonding material are an origination of a crack and are connected to the crack, thereby abrading the bonding material into a particle, when there exists the segregation of the phase II and the phase III, a size of the particle broken away is not uniform and a part cannot be broken away into a small particle and is deformed by slip and abraded to a lump.

When the abrasion of the bonding material is not uniform and smooth, protrusion of diamond from a surface of the bonding material and popping-out of the diamond due to the abrasion of the bonding material are bad, thereby deteriorating performance of the cutting tool.

In the present invention, a mechanical alloying method is applied to mix the matrix component powder with the phase II component powder and the phase III component powder in order to satisfy the requirements with respect to the distribution of the phase II and the phase III.

In the mechanical alloying process, a mixture of the matrix component powder, the phase II component powder, and the phase III component powder is repeatedly cold-welded and fractured due to a collision with steel balls, thereby uniformly distributing the phase II component powder and the phase III component powder with the lapse of time.

The mechanical alloying process according to an exemplary embodiment of the present invention may be performed by a vibration mill, an attrition mill, a ball mill, and a planetary mill, which may grind coarse powder and uniformly mix various kinds of powder.

Hereinafter, desirable conditions of four mechanical alloying processes will be described in detail.

First, Mechanical Alloying Method Using Vibration Mill

As shown in FIG. 1, a vibration mill 20 vibrates a vessel 22 at a high speed by using a vibration axis 21 to reciprocate balls 23 and powders in the vessel 22 according to the vibration to mix and grind the powders. Namely, a size of a matrix component may be reduced and a phase II component powder and a phase III component powder may be uniformly mixed by using the vibration mill.

To mix the matrix component powder, the phase II component powder, and the phase III component powder, a steel ball whose diameter is 3 to 12 mm is used, an amplitude of the vibration is 0.5 to 15 mm, a vibration frequency is 800 to 3,000 rpm, a vibration acceleration is 8 to 12 times of gravity acceleration, the inside of the vessel 22 is filled with grinding media to 50 to 85% of the vessel 22, and 30 to 70% of a free space of the vessel 22 is filled with the powder to mix. The mixing may be performed for 1 to 3 hours.

Second, Mechanical Alloying Method Using Attrition Mill

Figure 2:
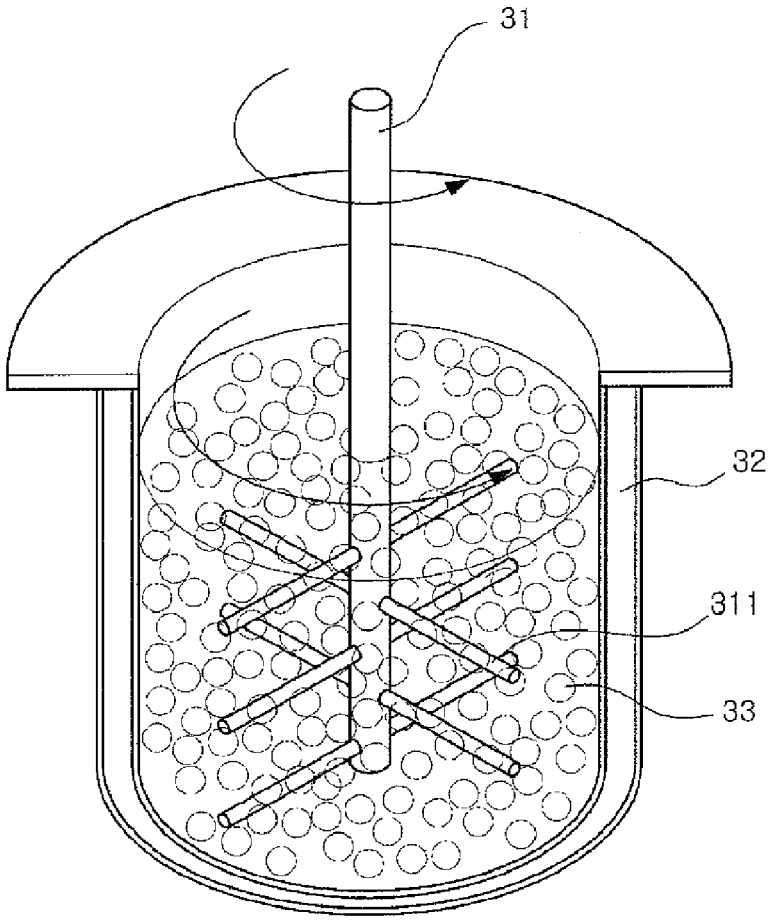
FIG. 2 is a schematic diagram illustrating an example of an attrition mill applied to mechanical alloying according to an exemplary embodiment of the present invention.

As shown in FIG. 2, an attrition mill 30 includes a rotation axis 31 including a plurality of arms 311 continually stirring grinding media 33 in a vessel 32 to generate attrition and collision between the grinding media 33 and powders and to make the powders mixed and ground.

Namely, a size of a matrix component may be reduced and a phase II component powder and a phase III component powder may be uniformly mixed by using the attrition mill 30.

To mix the matrix component powder, the phase II component powder, and the phase III component powder, a steel ball whose diameter is 3 to 10 mm is used, rpm of the rotation axis 31 is 300 to 900, the inside of the vessel 32 is filled with grinding media 33 to 30 to 65% of the vessel 32, and 30 to 70% of a free space of the vessel 32 is filled with the powder to mix. The mixing may be performed for 1 to 2 hours.

Also, since a frictional heat occurs in the operation, cooling water may be allowed to flow around the outside of the vessel 32 to control a temperature.

The attrition mill may reduce an operation time by rotating at a high speed and may increase a powder mixing amount and a grinding amount per unit time, thereby improving productivity.

Third, Mechanical Alloying Method Using Ball Mill

Figure 3:
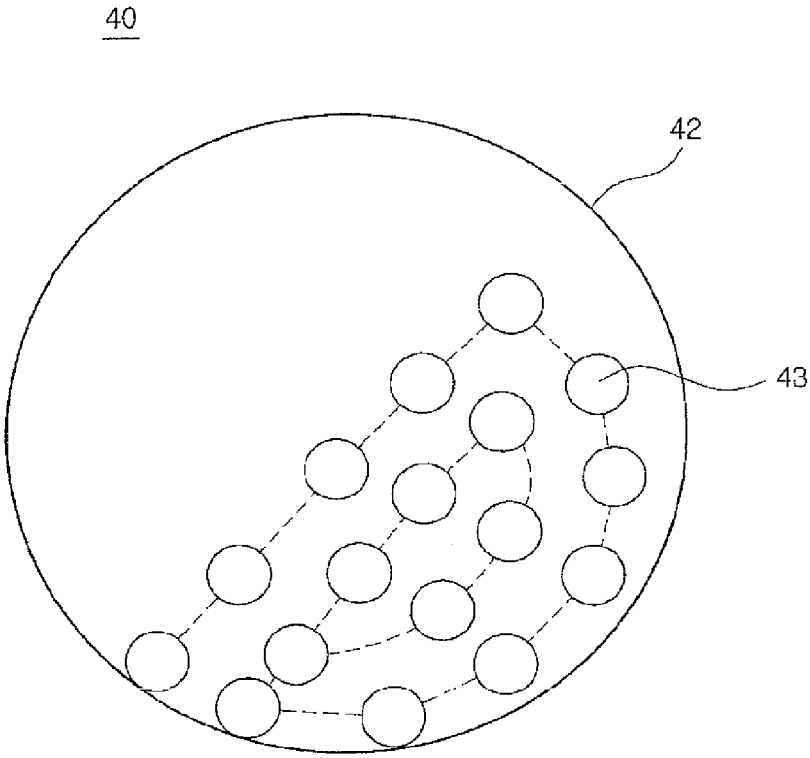
FIG. 3 is a schematic diagram illustrating an example of a ball mill applied to mechanical alloying awarding to an exemplary embodiment of the present invention.

As shown in FIG. 3, a ball mill 40 includes a vessel 42 in which powders are mixed and grinded by a collision generated by a fall of grinding media 43 and the powders by gravity.

Namely, a size of a matrix component may be reduced and a phase II component powder and a phase III component powder may be uniformly mixed by using the ball mill 40.

To mix the matrix component powder, the phase II component powder, and the phase III component powder, a steel ball whose diameter is 7 to 30 mm is used, rpm is 30 to 100, the inside of the vessel 42 is filled with the grinding media 43 to 30 to 65% of the vessel 42, and 30 to 70% of a free space of the vessel 42 is filled with the powder to mix. The mixing may be performed for 5 to 10 hours.

The ball mill has merits such as low-priced equipment and various sizes of a vessel, instead of long operation time.

Fourth, Mechanical Alloying Method Using Planetary Mill

Figure 4:
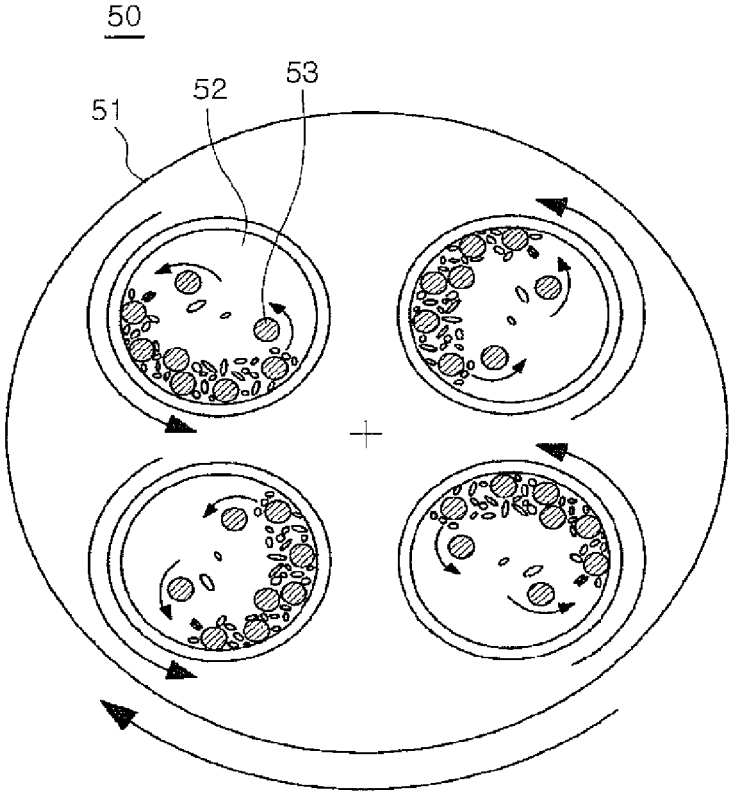
FIG. 4 is a schematic diagram illustrating an example of a planetary mill applied to mechanical alloying Larding to an exemplary embodiment of the present invention.

As a representative centrifugal mill, there is a planetary mill. As shown in FIG. 4, a planetary mill 50 includes a rotation plate 51 on which a vessel 52 including grinding media 53 orbits and rotates on its own axis as the earth revolving around the sun.

Though the ball mill collides by a force of gravity, the planetary mill may further increase gravity acceleration, thereby increasing effects of mixing and grinding the powders.

Namely, a size of a matrix component may be reduced and a phase II component powder and a phase III component powder may be uniformly mixed by using the planetary mill 50.

To mix the matrix component powder, the phase II component powder, and the phase III component powder, a steel ball whose diameter is 9 to 25 mm is used, a centrifugal acceleration is 8 to 12 times of gravity acceleration, the inside of the vessel 52 is filled with grinding media 53 to 30 to 65% of the vessel 52, and 30 to 70% of a free space of the vessel 52 is filled with the powder to mix. The mixing may be performed for 1 to 2 hours at 50 to 400 rpm.

Since the planetary mill generates a lot of heat, the planetary mill may not continually operate and may repeatedly perform operations of orbiting for 15 to 25 minutes, standing idle for 5 to 10 minutes, orbiting reversely for 15 to 25 minutes, and standing idle for 5 to 10 minutes.

once a rotation direction is changed during the operation, the planetary mill has a higher mixing and grinding efficiency than an operation in one direction.

An oxidation of the powders may occur during the mechanical alloying processes by the four methods.

To avoid the oxidation of the mixed powder, the equipment may be charged with a nitrogen gas or an argon gas during the process.

Also, to avoid the oxidation, an organic solvent such as alcohol, acetone, and toluene may be added to perform a wet operation during the mechanical alloying method.

In the above, the method of distributing a phase II in a matrix of a bonding material by adding a phase II component has been described. However, the present invention will not be limited to the method and the phase II may be distributed in the matrix of the bonding material by suitably controlling a mixing condition of matrix component powders, without adding the phase II component.

For example, when to disperse iron oxide particles as the phase II in the matrix, which is an iron, of the bonding materials in addition to a method of uniformly mixing iron oxide powder and iron powder that is the matrix component by a mechanical alloying method, iron oxide particles may be inputted into the matrix by the oxidation of the iron powder during the mechanical alloying process.

Namely, when the iron powder is mechanically alloyed in an oxygen atmosphere, a surface of the iron powder is oxidized and an oxide is also grinded to be dispersed in the iron powder while the iron powder is cold-welded and fractured.

Next, the mixture mixed by the mechanical alloying, method is mixed with diamond particles and a binder. In this case, the method of mixing is not specially limited. The mixing may be performed by a tubular mixer.

When using the tubular mixer, powders are charged less than 50% of a vessel and mixed for 20 to 60 minutes at 20 to 90 rpm.

Next, as described above, the mixed powder of the diamond particles and the binder is granulated by using a high viscous volatile liquid having viscosity more than 3.0 centipoise (cP).

Granulation of the mixed powder is an essential process for automation of a compacting process. Since a flow of the powder is largely improved by the granulation, a constant amount of the powder may be always filled during, an automated compacting.

When adding the viscous liquid to the mixed powders, the mixed powders are easily bound with each other into a granule by a capillary force of the liquid.

Since the added liquid is easily removed but the mixed binder binds the powders with each other, the formed granule has strength capable of being treated.

The viscosity of the liquid according to an exemplary embodiment of the present invention may be more than 3 cP and may be volatile.

When the viscosity of the liquid is less than 3 cP, since the capillary force decreases due to low viscosity of the liquid, it is difficult to granulate a coarse particle or an irregular shaped particle.

However, generally used powders whose size corresponds to several microns may be enough granulated by using methanol whose viscosity is 0.6 cP.

Also, when the liquid is nonvolatile, since the liquid remains after drying granules, a compacting operation that is a next operation cannot be performed due to a flow deteriorated by the viscosity of the remained liquid.

The high viscous volatile liquid may be a volatile silicone oil. When the high viscous volatile liquid is the volatile silicone oil, an amount of the added liquid may be 80 to 130 ml per 1 kg of the mixed powder.

When the addition amount is less than 80 ml, since the oil cannot wet a surface of the powders enough, the capillary force does not Or and a granule is not formed.

Also, when the addition amount is more than 130 ml, since the powders are pasted together with each other due to a lot of the oil, the granulation cannot be performed.

Next, the granulated mixed powders are cold-compacted in the shape of the cutting tip and pressurized-sintered, thereby manufacturing the cutting tip for a cutting tool.

A sintering temperature of a hot-press awarding to an exemplary embodiment of the present invention may be 750 to 980° C.

It is difficult to get enough densification when sintering general matrix component powders at a low temperature. Accordingly, a high temperature is required to raise a sintering density. When a matrix component is iron, a high temperature of 1000° C. is required.

Since a lot of micro cracks are formed in the matrix component powders and a size of particles is reduced during the mechanical alloying process, the bonding material is sintered at a low temperature of 750° C.

Accordingly, since a driving force for sintering is largely increased, the sintering is performed at the low temperature and the compact is densified.

A reduction of the sintering temperature increases a lifetime of a graphite mold, thereby causing a reduction of costs for manufacturing tools.

When the sintering temperature is less than 750° C., since the bonding material cannot be densified enough due to short of the driving force of the sintering, a density of the cutting tip is rapidly decreased and becomes brittle.

When the sintering temperature is more than 980° C., diamond particles mixed with the bonding material are transformed into graphite and a thermal deterioration phenomenon that a strength of the diamond particles is rapidly decreased is accelerated. When the deterioration of the diamond particles get worse, excellent cutting speed and a long lifetime cannot be acquired.

As described above, when applying the bonding material whose microstructure and mechanical property are excellent, cutting speed and a lifetime of a cutting tool are largely improved at the same time and manufacturing costs of the cutting tool may be notably lowered due to a reduction of a cost of a raw material and a process cost.

Hereinafter, the present invention will be described in detail via the embodiments.

Embodiment 1

Iron powders ASC300 manufactured by Hoganas Company, to 45 μm, which were a matrix component, were added with iron oxide powders $Fe_2O_3$ manufactured by Sigma-Aldrich Company, to 1.5 μm, which were a phase II component, to a volume fraction of 0.3, 5, 15, and 20%, were mechanically alloyed, were added with 2 wt % of paraffin wax, were mixed by a tubular mixer, were compacted by a compaction pressure of 200 MPa, and were sintered by a hot press at 35 MPa and a temperature of 850° C. for 5 minutes, thereby manufacturing a specimen for analyzing a physical property.

The mechanical alloying was performed by a vibration mill. In this case, the mechanical alloying was performed at an amplitude of 10 mm and a frequency of 1000 rpm for an hour while a vessel of 5 l was filled with 2.5 l of balls, whose diameter was 10 min, and 2.5 kg of mixed powders.

With respect to a surface of the specimen manufactured as described above, a result of measuring a volume fraction of the phase II and pore content in the matrix, hardness, and traverse rupture strength is shown in Table 1.

The volume fraction of the phase II in the matrix was measured by an image analyzer and the pore content was measured by a Porosimetry manufactured by Micrometrics Company.

TABLE 1

| Specimens No. | Iron Oxide Addition Amount (vol. %) | Physical Properties: Volume Franction of Phase II (vol. %) | Porosity (vol. %) | Hardness (HRB) | Traverse Rupture Strength (kgf/mm$^2$) |
|---|---|---|---|---|---|
| Comparison Example 1 | 0.3 | 0.43 | 0 | 66 | 105 |
| Invention Example 1 | 5 | 6.85 | 2.8 | 79 | 127 |
| Invention Example 2 | 15 | 13.9 | 4.2 | 113 | 88 |
| Comparison Example 2 | 20 | 20.8 | 8.6 | 116 | 74 |

As shown in Table 1, it may be known that an addition amount of the iron oxide that is the phase II component is similar to the amount of the phase II in the matrix and the hardness and the traverse rupture strength are excellent when having the volume fraction of the phase II and the pore content according to an embodiment of the present invention.

Namely, the invention examples 1 and 2 showed the traverse rupture strength more than 80 kgf/mm$^2$ and the hardness more than HRB 70.

On the other hand, in the case of the comparison example 1, since a dispersion hardening effect was small due to the small volume fraction of the phase II, the hardness was less than HRB 70.

Also, in the case comparison example 2, since the volume fraction of the phase II was excessive and the porosity was high, the traverse rupture strength was less than 80 kgf/mm$^2$.

Embodiment 2

According to the invention example 1 of the embodiment 1, iron powders ASC300 manufactured by Hoganas Company, to 45 μm, which were a matrix component, were added with iron oxide powders $Fe_2O_3$ manufactured by Sigma-Aldrich Company, to 1.5 μm, which were a phase II component, to a volume fraction of 5%, were mechanically alloyed, were mixed with paraffin wax and diamond particles, were added with a volatile silicone oil by 110 ml per 1 kg of the mixed powder, were cold-compacted, and were sintered by a hot press at a temperature of 850° C., according to a method of manufacturing a cutting tip for a diamond tool.

A cutting tip manufactured as described above was laser-welded to a metal core to manufacture a saw blade of 14 inches (Invention saw blade 1).

In this case, the diamond particles were MBS-960KM manufactured by DI Company, whose particle size was US 30/40 mesh and volume fraction was 3.4%.

On the other hand, cobalt powders EF manufactured by Umicore Company were a main component, were added with bronze (CuSn) powders at a weight fraction of 10%, were mixed by a general tubular mixer, were mixed with the diamond particles and paraffin wax identical with the invention saw blade 1, were granulated, were cold-compacted, and sintered by a hot press at a temperature of 850° C., thereby manufacturing a cutting tip (Comparison saw blade 1).

With respect to the saw blades manufactured by the above methods, a test of dry-cutting washed concrete has been performed and a result of the cutting test is shown in Table 2.

The cutting test was performed by using a STIHL 6.5 HP cutting machine, a thickness of the washed concrete was 50 mm, and a cutting length was 300 mm, and 200 times of cutting was performed.

A cutting speed index and a lifetime index were calculated by measuring a cutting time consumed in the cutting condition and a height decrease of the cutting tip.

TABLE 2

| Division | Cutting Speed Index (cm$^2$/min) | Lifetime Index (m$^2$/mm) |
|---|---|---|
| InventionSaw Blade 1 | 620 | 16.1 |
| Comparison Saw Blade 1 | 560 | 8.5 |

As shown in Table 2, it may be known that Invention saw blade 1 according to an exemplary embodiment of the present invention has more excellent cutting speed and lifetime than Comparison saw blade 1.

Particularly, it may be known that the lifetime index of Invention saw blade 1 is higher than two times of the lifetime index of Comparison saw blade 1.

On the other hand, as a result of observing a microstructure of a bonding material of an polished cutting tip of Invention saw blade 1 by using an electron microscope SEM, an inclusion formed of an iron oxide whose size was less than 1.5 μm was uniformly distributed in the bonding material of the cutting tip.

Volume fractions of the inclusion formed of the iron oxide and pores were 6.1% and 2.3%, respectively. It may be checked that a distance between the inclusion and the pore is less than 10 μm.

Also, a result of measuring a property with respect to the cutting tip of the invention saw blade 1, it may be know that a hardness of the bonding material is HRB 76 and traverse rupture strength is 106 kgf/mm$^2$ though diamond particles are added.

Embodiment 3

Iron powders ASC300 manufactured by Hoganas Company, to 45 μm, which were a matrix component, were added with iron oxide powders $Fe_2O_3$ manufactured by Sigma-Aldrich Company, to 1.5 μm, which were a phase II component, to a volume fraction of 5%, were mechanically alloyed, were added with 2 wt % of paraffin wax, were mixed by a tubular mixer, were compacted by a compaction pressure of 200 MPa, and were sintered by a hot press at 35 MPa and a temperature of 850° C. for 5 minutes, thereby manufacturing a specimen for analyzing a physical property.

The mechanical alloying was performed by an attrition mill. In this case, the mechanical alloying was performed at 600 rpm for an hour while a vessel of 2 l was filled with 1 l of balls, whose diameter was 3 mm, and 1 kg of mixed powders.

With respect to a surface of the specimen manufactured as described above, a result of measuring sizes and distances of the phase II and pores in the matrix, hardness, and traverse rupture strength is shown in Table 3.

The sizes and the distances of the phase II and the pores were measured by an image analyzer.

TABLE 3

| Specimen No. | Size of Added Iron Oxide (μm) | Physical Properties: Size of Phase II (μm) | Size of Pore (μm) | Distance Between Phase II and Pore (μm) | Hardness (HRB) | Traverse Rupture Strength ($Kg/mm^2$) |
|---|---|---|---|---|---|---|
| Invention Example 3 | 0.5 | 0.5 | 0.8 | 2.6 | 85 | 131 |
| Invention Example 4 | 3 | 2.8 | 1.2 | 12.9 | 74 | 103 |
| Comparison Example 3 | 8 | 7.1 | 1.0 | 28.5 | 68 | 74 |

In the result, since a part of the iron oxide powers was grinded during the mechanical alloying process, there occurred cases in which the size of the phase II was smaller than the size of the added iron oxide.

As shown in Table 3, in the case of the invention examples 3 and 4, the hardness was more than HRB 70 and the traverse rupture strength was more than 80 $kgf/mm^2$.

On the other hand, in the case of Comparison example 3, though a distance between the phases II was less than 40 μm, the hardness was less than HRB 70 and the traverse rupture strength was less than 80 $kgf/mm^2$.

From the result, it may be known that the size of the phase II is an important factor in addition to the distance between the phases II.

It may be known from Table 3, depending on the size of the phase II, the traverse rupture strength is more largely changed than the hardness. This is because a size of a crack has a large effect on rupture strength.

To acquire a property adequate for the present invention, the size of the phase II and the pore has to be less than 3 min.

Embodiment 4

According to the invention example 3 of the embodiment 3, iron powders ASC300 manufactured by Hoganas Company, to 45 μm, which were a matrix component, were added with iron oxide powders $Fe_2O_3$ manufactured by Sigma-Aldrich Company, 0.5 μm, which were a phase II component, to a volume fraction of 5%, were mechanically alloyed by an attrition mill, were mixed with paraffin wax and diamond particles, were added with a volatile silicone oil by 110 ml per 1 kg of the mixed powder to be granulated, were cold-compacted, and were sintered by a hot press at a temperature of 850° C.

A cutting tip manufactured as described above was brazed to a metal core to manufacture a saw blade of 14 inches (Invention saw blade 2).

In this case, the diamond particles were MBS-970K manufactured by DI Company, whose particle size was US 30/40 mesh and volume fraction is 6.8%.

On the other hand, cobalt powders EF manufactured by Umicore Company were a main component, were added with WC powders at a weight fraction of 10%, were mixed by a general tubular mixer, were mixed with the diamond particles and paraffin wax identical with the invention saw blade 2, were granulated, were cold-compacted, and sintered by a hot press at a temperature of 850° C., thereby manufacturing a cutting tip (Comparison saw blade 2).

A test of wet-cutting cured concrete has been performed by the saw blades manufactured by the above methods and a result of the cutting test is shown in Table 4.

The cutting test was performed by using a TARGET 65 HP cutting machine, a cutting depth is 70 mm, and a cutting length is 300 mm, and three times of cutting was performed.

A cutting speed index and a lifetime index were calculated by measuring a cutting time consumed in the cutting condition and a height decrease of the cutting tip.

TABLE 4

| Division | Cutting Speed Index ($m^2/min$) | Lifetime Index ($m^2/mm$) |
|---|---|---|
| Invention Saw Blade 2 | 0.45 | 9.3 |
| ComparisonSaw Blade 2 | 0.37 | 5.8 |

As shown in Table 4, it may be known that the invention saw blade 2 according to an exemplary embodiment of the present invention has more excellent cutting speed and lifetime than the comparison saw blade 2.

As a result of observing a microstructure of a bonding material of an polished cutting tip of the invention saw blade 2 by using an electron microscope SEM, it may be checked that an inclusion formed of an iron oxide whose size is less than 1 μm and pores are uniformly distributed in the bonding material of the cutting tip, a volume fraction is 7.5%, and a distance between particles is less than 5 μm.

Also, as a result of measuring a property of the cutting tip of the invention saw blade 2, a hardness of the bonding material is HRB 80 and a traverse rupture strength of the bonding material was 104 $kgf/mm^2$ though diamond particles were added.

Embodiment 5

Iron powders ASC300 manufactured by Hoganas Company, to 45 μm, were added with alumina powders Nabalox manufactured by Nabaltec Company, to 3 μm, to a volume fraction of 5%, were mechanically alloyed, were added with 2 wt % of paraffin wax, were mixed by a tubular mixer, were compacted by a compaction pressure of 200 MPa, and were sintered by a hot press at 35 MPa and a temperature of 850° C. for 5 minutes, thereby manufacturing a specimen for analyzing a physical property.

The mechanical alloying has been performed by a vibration mill, an attrition mill, a ball mill, and a planetary mill, and respective mechanical allying conditions are shown in Table 5.

In Table 5, except replacing the mechanical allying the iron powder and the alumina powders with mixing, by a tubular mixer, a condition of a comparison example 4 was identical with invention examples.

A result of measuring properties of the specimens manufactured as described above is shown in Table 6.

TABLE 5

| | Invention Example 5 | Invention Example 6 | Invention Example 7 | Invention Example 8 | Comparison Example 4 |
|---|---|---|---|---|---|
| Alloying Method | Vibration Mill | Attrition Mill | Ball Mill | Planetary Mill | — |
| Grinding Media | Steel Ball of 10 mm | Steel Ball of 3 mm | Steel Ball of 12 mm | Steel Ball of 12 mm | — |
| Vessel | 51 | 21 | 51 | 1.41 | 51 |
| Charged Mixed Powder Amount | 2.5 kg | 1 kg | 2.5 kg | 700 g | 10 kg |
| Tolal Operation Time | 1 hour | 1 hour | 5 hours | 1 hour | 40 mins |
| Rpm | 1000 | 600 | 60 | 200 | 40 |
| Other Conditions | Amplitude of 10 mm | — | — | Three Times of-Operation for 20 mins and Idle for 10 mins | — |

TABLE 6

| Specimens No. | Volume Fraction of Phase II (vol %) | Amount of Pore (vol %) | Size of Phase II And Pore (μm) | Distance between Phase II and Pore (μm) | Hardness (HRB) | Traverse Rupture Strength (kgf/mm$^2$) |
|---|---|---|---|---|---|---|
| Comparison Example 4 | 5.38 | 8.7 | 3.0 | 18.3 | 59 | 67 |
| Invention Example 5 | 4.85 | 1.7 | 2.9 | 11.1 | 82 | 106 |
| Invention Example 6 | 4.62 | 1.5 | 2.6 | 12.6 | 84 | 105 |
| Invention Example 7 | 5.41 | 2.9 | 2.9 | 10.9 | 82 | 110 |
| Invention Example 8 | 4.89 | 2.3 | 3.0 | 11.5 | 86 | 102 |

As shown in Table 6, all the mechanically alloyed invention examples 5 through 8 showed the hardness more than HRB 70 and the traverse rupture strength more than 80 kgf/mm$^2$.

On the other hand, the hardness and the traverse rupture strength of the simply mixed comparison example 4 were low due to very high porosity.

Accordingly, to acquire a property adequate for the present invention, the iron powders and the phase II powders may be mechanically alloyed.

Embodiment 6

According to the invention examples 5 through 8 and the comparison example 4 of the embodiment 5, iron powders ASC300 manufactured by Hoganas Company, to 45 μm, were added with alumina powders Nabalox manufactured by Nabaltec Company, to 3 μm, to a volume fraction of 5%, were mechanically alloyed, according to a method of manufacturing a cutting tip of a diamond tool, were mixed with paraffin wax and diamond particles by a tubular mixer for 40 minutes, were added with a volatile silicone oil by 110 ml per 1 kg of mixed powder, were granulated, were cold-compacted, and were sintered by a hot press at a temperature of 800° C., thereby manufacturing the cutting tip.

The cutting tip manufactured as described above was welded to a metal core by using laser to manufacture a saw blade of 9 inches (invention saw blades 3 through 6 and a comparison saw blade 3).

The invention saw blades 3 through 6 and the comparison saw blade 3 were manufactured by using the invention example 5 through 8 and the comparison example 4, respectively.

In this case, the diamond particles were MBS-970K whose particle size was US 30/40 mesh and volume fraction was 2.8%.

A test of dry-cutting granite and concrete by using the saw blades manufactured as described above has been performed, and a cutting performance test result is shown in Tables 7 and 8.

Table 7, a granite cutting test result is shown. In Table 8, a concrete cutting test result is shown.

The cutting test was performed by a BOSCH 2.7 HP cutting machine. In the case of the granite, 200 times of cutting in which a cutting depth was 20 mm and a cutting length was 300 mm was performed. In the case of the concrete, 200 times of cutting in which a cutting depth is 30 mm and a cutting length is 300 mm was performed.

A cutting speed index and a lifetime index were calculated by measuring a time consumed for cutting and a height decrease of the cutting tip in the cutting condition.

TABLE 7

| | Comparison Saw Blade 3 | Invention Saw Blade 3 | Invention Saw Blade 4 | Invention Saw Blade 5 | Invention Saw Blade 6 |
|---|---|---|---|---|---|
| Cutting Speed Index (cm$^2$/min) | 320 | 401 | 402 | 410 | 398 |
| Life time Index (m$^2$/mm) | 1.2 | 2.5 | 3.8 | 4.3 | 2.6 |

TABLE 8

| | Comparison Saw Blade 3 | Invention Saw Blade 3 | Invention Saw Blade 4 | Invention Saw Blade 5 | Invention Saw Blade 6 |
|---|---|---|---|---|---|
| Cutting Speed Index ($cm^2$/min) | 580 | 750 | 743 | 782 | 775 |
| Life time Index ($m^2$/mm) | 2.9 | 4.5 | 6.1 | 5.6 | 3.9 |

As shown in Tables 7 and 8, it may be known that cutting speed and a lifetime of all the invention saw blades 3 through 6 have improved more than the comparison saw blade 3 when the concrete and the granite are used as a workpiece.

INDUSTRIAL APPLICABILITY

The present invention may provide a cutting tip and a cutting tool having excellent cutting speed and a long lifetime at a much lower price.

The invention claimed is:

1. A cutting tip for a cutting tool, the cutting tip comprising: an abrasive material for cutting a workpiece; and a sintered bonding material maintaining the abrasive material, wherein the bonding material is formed of a metal matrix formed of one of a metal and a metal alloy; the metal matrix comprises a phase II and/or pore at a volume fraction of 0.5 to 30%; the phase II comprises at least one selected from a group consisting of a nonmetallic inclusion, ceramic, and cement; a size of each of the phase II and the pore is less than 3 μm; and a distance between the phase II and the pores is less than 40 μm.

2. The cutting tip of claim 1, wherein the metal matrix is formed of one of one selected from a group consisting of Fe, Cu, Ni, Co, Cr, Mn, and W and one selected from a group consisting of an alloy of Fe, Cu, Ni, Co, Cr, Mn, and W, and stainless steel.

3. The cutting tip according to claim 1, wherein the nonmetallic inclusion is at least one selected from a group consisting of a metal oxide, a metal nitride, a metal carbide, a metal carbonitride, and a metal sulfide.

4. A cutting tip for a cutting tool, the cutting tip comprising: an abrasive material for cutting a workpiece; and a sintered bonding material maintaining the abrasive material, wherein the bonding material is formed of a metal matrix formed of one of a metal and a metal alloy; the metal matrix comprises a phase II and/or pore at a volume fraction of 0.5 to 30%; the metal matrix comprises a phase III at a volume fraction of 0.1 to 10%; the phase II is at least one selected from a group consisting of a non-metallic inclusion, ceramic, and cement and the phase III is a low melting point metal; a size of each of the phase II and the pore is less than 3 μm; and the phase III has a size less than 5 μm.

5. The cutting tip of claim 4, wherein the metal matrix is formed of one of one selected from a group consisting of Fe, Cu, Ni, Co, Cr, Mn, and W and one selected from a group consisting of an alloy of Fe, Cu, Ni, Co, Cr, Mn, and W and stainless steel.

6. The cutting tip according to claim 4, wherein the nonmetallic inclusion is at least one selected from a group consisting of a metal oxide, a metal nitride, a metal carbide, a metal carbonitride and a metal sulfide.

7. The cutting tip according to claim 4, wherein the phase III is at least one selected from a group consisting of tin (Sn) and a bronze alloy (Cu—Sn).

8. The cutting tip of claim 4, wherein an amount of the phase III corresponds to a volume fraction of 0.1 to 5%.

9. A cutting tip for a cutting tool, the cutting tip comprising:
- a plurality of abrasive particles; and
  - a powder-sintered bonding material, wherein the powder-sintered bonding material is formed of a iron matrix;
  - the iron matrix comprises phase II at a volume fraction of 0.5 to 15%;
  - the phase II is at least one selected from a group consisting of a non-metallic inclusion and ceramic;
  - a size of the phase II is less than 3 μm;
  - a distance between the phases II is less than 40 μm;
  - a hardness of the iron bonding material is more than 70 HRB; and
  - a transverse rupture strength of the iron bonding material that does not include an abrasive material is more than 80 kgf/mm2.

10. The cutting tip of claim 9, wherein a pore is included in the iron matrix at a volume fraction less than 5%, a size of the pore is less than 3 μm and a distance between the phase II and the pores is less than 40 μm.

11. The cutting tip according to claim 9, wherein the nonmetallic inclusion is at least one selected from a group consisting of a metal oxide, a metal nitride, a metal carbide, a metal carbonitride, and a metal sulfide.

12. The cutting tip according to claim 9, the cutting tip used for dry cutting, wherein a volume fraction of the diamond particles is 2 to 4%.

13. The cutting tip of claim 9, wherein a toughness index of the diamond particles is more than 85 and a size of the diamond particle is more than 350 μm.

14. A cutting tool comprising the cutting tip according to claim 9.

15. The cutting tool of claim 14, wherein the cutting tool is one of a segment type cutting tool, a rim type cutting tool, a cup type cutting tool, a wire saw, and a core drill.

* * * * *

UNITED STATES PATENT AND TRADEMARK OFFICE

CERTIFICATE OF CORRECTION

PATENT NO. : 8,360,046 B2
APPLICATION NO. : 12/280469
DATED : January 29, 2013
INVENTOR(S) : Kim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1193 days.

Signed and Sealed this
First Day of September, 2015

Michelle K. Lee

Michelle K. Lee
*Director of the United States Patent and Trademark Office*